US009243462B2

(12) United States Patent
Gutierrez et al.

(10) Patent No.: US 9,243,462 B2
(45) Date of Patent: Jan. 26, 2016

(54) HIGH FLOW HOT STAB CONNECTION

(71) Applicants: Luis Gutierrez, Houston, TX (US); Shane Wells, Houston, TX (US); Daniel Gutierrez, Houston, TX (US); James Edward Fuselier, Mamou, LA (US)

(72) Inventors: Luis Gutierrez, Houston, TX (US); Shane Wells, Houston, TX (US); Daniel Gutierrez, Houston, TX (US); James Edward Fuselier, Mamou, LA (US)

(73) Assignee: BP Corporation North America Inc., Houston, TX (US)

( * ) Notice: Subject to any disclaimer, the term of this patent is extended or adjusted under 35 U.S.C. 154(b) by 184 days.

(21) Appl. No.: 13/834,237

(22) Filed: Mar. 15, 2013

(65) Prior Publication Data

US 2013/0248195 A1 Sep. 26, 2013

Related U.S. Application Data

(60) Provisional application No. 61/614,510, filed on Mar. 23, 2012.

(51) Int. Cl.
*E21B 19/16* (2006.01)
*E21B 33/038* (2006.01)

(52) U.S. Cl.
CPC ..... *E21B 19/16* (2013.01); *E21B 33/038* (2013.01)

(58) Field of Classification Search
CPC ..... E21B 19/16; E21B 33/038
USPC ..... 166/338, 341, 344, 345, 351, 360
See application file for complete search history.

(56) References Cited

U.S. PATENT DOCUMENTS

| | | | | |
|---|---|---|---|---|
| 3,460,614 | A * | 8/1969 | Burgess | 166/335 |
| 4,682,913 | A * | 7/1987 | Shatto et al. | 405/169 |
| 4,863,314 | A * | 9/1989 | Baugh | 405/191 |
| 5,284,210 | A | 2/1994 | Helms et al. | |
| 6,009,950 | A * | 1/2000 | Cunningham et al. | 166/344 |
| 6,085,785 | A * | 7/2000 | Smith, III | 137/614.04 |
| 2007/0158078 | A1 | 7/2007 | Boyd | |
| 2013/0334448 | A1 * | 12/2013 | Hodnefjell et al. | 251/304 |

FOREIGN PATENT DOCUMENTS

| | | |
|---|---|---|
| GB | 2 190 969 | 3/1987 |

* cited by examiner

*Primary Examiner* — James G Sayre
(74) *Attorney, Agent, or Firm* — Jayne Piana

(57) ABSTRACT

A subsea fluid connector is disclosed. The body of the connector has a first portion and a connection profile portion, a first port through an outer surface of the first portion, a plurality of openings through an outer surface of the connection profile portion, and a plurality of fluid passages through the body and coupled between the first port and the plurality of openings. The subsea fluid connector may have a first fluid flow path extending through the plurality of fluid passages between the first port through the outer surface of the first portion and the plurality of openings through the outer surface of the connection profile portion, and a second fluid flow path extending through a fluid passage between a second port through the outer surface of the first portion and a third port through the outer surface of the connection profile portion.

17 Claims, 4 Drawing Sheets

HIGH FLOW HOT STAB CONNECTION

CROSS-REFERENCE TO RELATED APPLICATIONS

The present application claims the benefit of U.S. Provisional Application Ser. No. 61/614,510, filed Mar. 23, 2012 entitled "High Flow Hot Stab Connection".

BACKGROUND

In producing oil and gas from offshore wells, a wellhead is employed at the sea floor to regulate and direct the flow of hydrocarbons from the reservoir, through tubular risers, and to the surface where the fluids are collected in a receiving facility located on a platform or other vessel. Normally, the flow of hydrocarbons is controlled via a series of valves installed on the wellhead, the risers, and in the receiving facility at the surface. Other subsea equipment, such as manifolds and pipelines, also assist in directing the produced fluids.

An unmanned submersible vehicle controlled from the surface, or a remotely operated vehicle (ROV), can be used to inspect subsea structures and equipment, and to control or manipulate valves. ROVs mechanically control valves and provide hydraulic pressure to the subsea wellhead or other equipment via "hot stab" connections and panels. A hot stab connection is a device used to move fluid, often hydraulic fluid, from one line in a first device to another line in a second device. Hot stabs can also be used in other subsea fluid connections, for quick, releasable, and flexible fluid connections between various systems.

High fluid flow rates are often needed in subsea equipment. Accordingly, there, remains a need in the art for systems and methods that provide high flows through hot stab connections.

SUMMARY

Embodiments of a hot stab connecter are disclosed. A high flow capacity flow path is provided through the hot stab connecter between a first fluid port in the connector body and a plurality of openings disposed at an axially displaced portion of the connector body. The flow path between the first port and the openings may include a transition chamber and a plurality of independent fluid passages corresponding to the plurality of openings.

In some embodiments, a subsea fluid connector includes a body having a first portion and a connection profile portion, a first port through an outer surface of the first portion, a plurality of openings through an outer surface of the connection profile portion, and a plurality of fluid passages through the body and coupled between the first port and the plurality of openings. Each of the plurality of fluid passages may be coupled between one corresponding opening and the first port. The connector may further include a fluid chamber disposed between and in fluid communication with the first port and the plurality of fluid passages. The first port, the plurality of fluid passages, and the plurality of openings may form a first fluid flow path. The connector may further include a second fluid flow path including a second port though the outer surface of first portion, a third port through the outer surface of the connection profile portion, and a fluid passage coupled between the second and third ports. The second fluid flow path and its fluid passage may he independent of the first fluid flow path and the plurality of fluid passages. The connection profile portion may include a first radially reduced recessed portion. The connection profile portion may include a second radially reduced recessed portion. The openings may be elongated, oblong, pill shaped, or a combination thereof. Each opening may include a flow area and the plurality of openings may include an effective flow area. The effective flow area may be larger than the flow area of each opening. The first port may be configured to communicate with all fluid flow from the plurality of openings and the plurality of fluid passages. The plurality of openings may include an increased effective flow area and the connection profile portion may include an API standardized profile. The API standardized connection profile may include at least one reduced recessed surface to communicate with the increased effective flow area. The connector may further include a plug disposed adjacent the fluid chamber. The connector may further include an end piece coupled adjacent the plug to back up the plug. The connection profile portion may be configured to mate with a female connector to provide a high flow capacity and API standardized fluid connector.

In some embodiments, a subsea fluid connector includes a body having a first portion and a connection profile portion to be received by a female connector, a first fluid flow path extending through a plurality of fluid passages between a first port through an outer surface of the first portion and a plurality of openings through an outer surface of the connection profile portion, and a second fluid flow path extending through a fluid passage between a second port through the outer surface of the first portion and a third port through the outer surface of the connection profile portion. The first fluid flow path may be completely separate from the second fluid flow path.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of exemplary embodiments, reference will now be made to the accompanying drawings in which.

DETAILED DESCRIPTION

Figure 1:
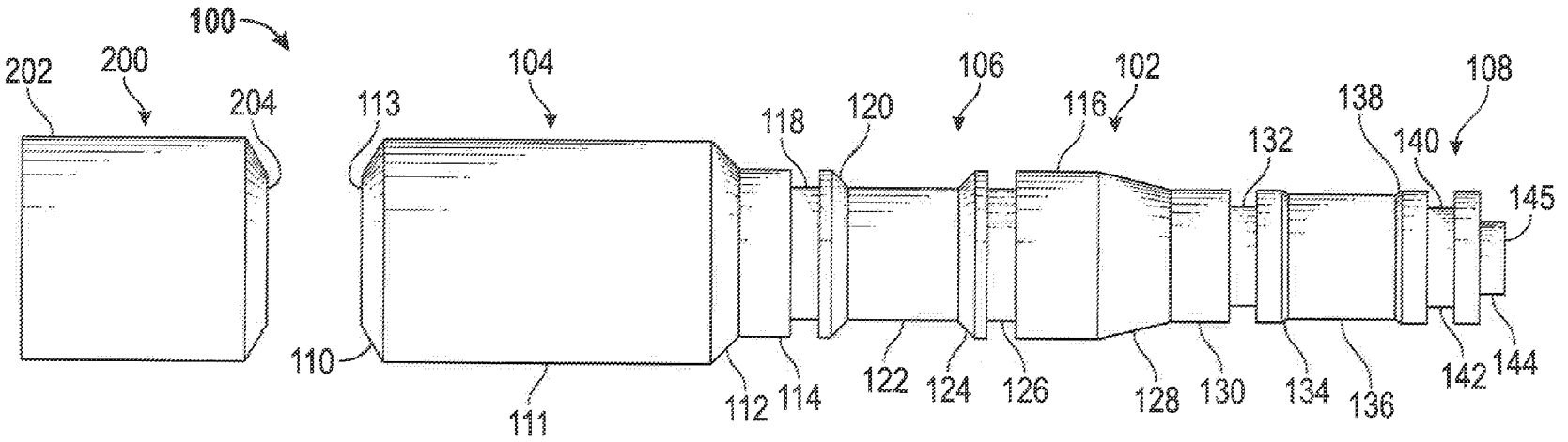
FIG. 1 is a side view of a fluid connector body in accordance with the principles disclosed herein.

In the drawings and description that follow, like parts are typically marked throughout the specification and drawings with the same reference numerals, respectively. Certain terms are used throughout the description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

The terms "including" and "comprising" are used in an open-ended fashion, and thus should be interpreted to mean "including, but not limited to . . . ." Unless otherwise specified, any use of any form of the terms "couple", "attach", "connect" or any other term describing an interaction between elements is not meant to limit the interaction to direct interaction between the elements and may also include indirect interaction between the elements described. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring initially to FIG. 1, a fluid connector 100 is shown. In some embodiments, the fluid connector 100 is a subsea fluid connector. In some embodiments, the fluid connector 100 is a subsea hot stab. The connector 100 includes a body 102 having a first body portion 104, an intermediate body portion 106, and a second body portion 108. The intermediate and second body portions 106, 108 may also be referred to as a connection profile portion of the body 102. The first body portion 104 includes a cylindrical portion 111 having an end surface 113 and end tapered surfaces 110, 112. The tapered surface 112 transitions to a first outer diameter portion 114 of the intermediate body 106. The first outer diameter portion 114 includes a first recessed portion 118 and a tapered surface 120 that transitions to a second recessed portion 122. The second recessed portion 122 transitions to a second outer diameter portion 116 via a tapered surface 124. The second outer diameter portion 116 includes a third recessed portion 126. The second outer diameter portion 116 includes a tapered surface 12.8 that transitions to a first outer diameter portion 130 of the second body portion 108. The first outer diameter portion 130 includes a first recessed portion 132 and a tapered surface 134 that transitions to a second recessed portion 136. The second recessed portion 136 transitions to a second outer diameter portion 140 via a tapered surface 138. The second outer diameter portion 140 includes a third recessed portion 142 and a terminal end recessed portion 144 with end surface 145.

Adjacent the end surface 113 is an end piece 200 having an end body 202 and a surface 204 that is connectable to the end surface 113 of the connector 100 by welding or other known means tier connecting two cylindrical bodies.

In some embodiments, the outer connection profile surface of the intermediate and second body portions 106, 108 is based on a standardized connection profile such that this "male" portion of the connector 100 will fit into standardized "female" portions of connectors in other well equipment. in some embodiments, the outer connection profile surface is standardized according to American Petroleum Institute (API) standards, In certain respects, the connector 100 includes features that deviate within acceptable API standards to provide additional capabilities of the connector 100 while still including the API compatibility standards, as will become more apparent below. For example, the recessed surface 122 is recessed below or offset radially within the radial outer diameter of the intermediate portion 106 as defined by outer surfaces 114, 116. Similarly, the recessed surface 136 is recessed below or offset radially within the radial outer diameter of the second portion 108 as defined by outer surfaces 130, 140. In some embodiments, the recessed surfaces 122 and/or 136 are further radially reduced or recessed relative to their respective outer diameter surfaces 114, 116 and 130, 140. Further details on these principles are provided below.

Figure 2:
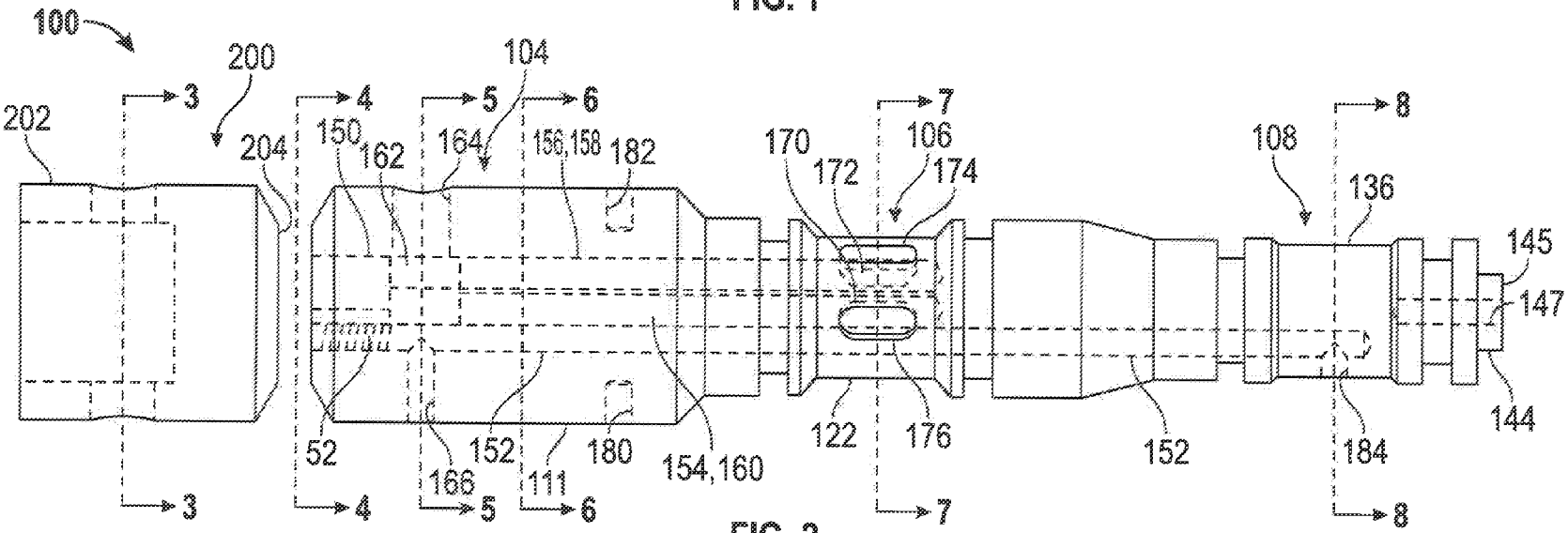
FIG. 2 is a side view of the fluid connector of FIG. 1 including phantom lines for showing internal fluid passages of the fluid connector.
Figure 3:
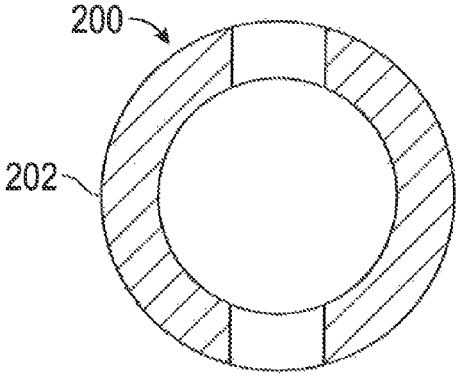
FIGS. 3-8 are various radial cross-sections and end views of the fluid connector of FIGS. 1 and 2, with reference to the section lines shown in FIG. 2.
Figure 4:
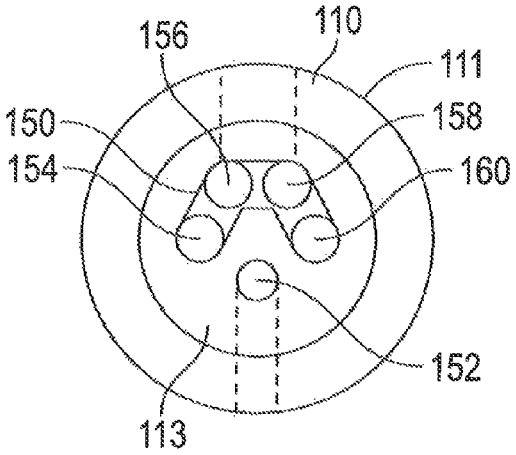
Figure 5:
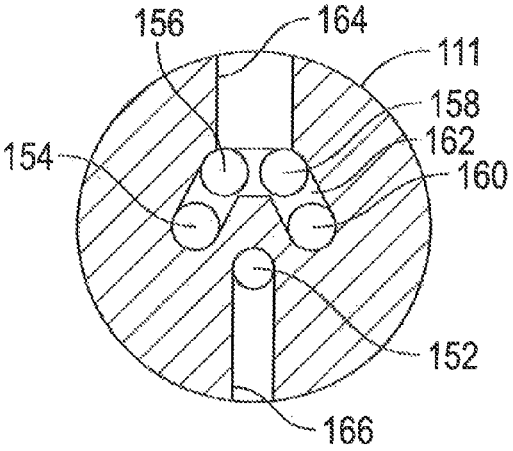
Figure 6:
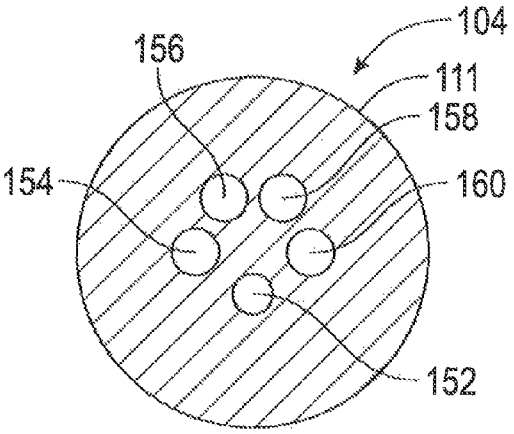
Figure 7:
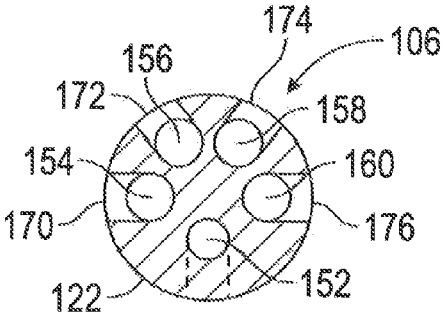
Figure 8:
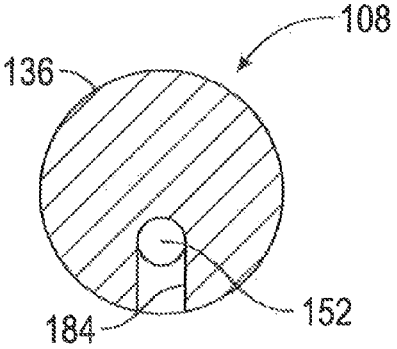

Referring now to FIG. 2 and associated cross-section FIGS. 3-8, the connector 100 includes an internal network of fluid passages or flow bores for transmitting fluid through the connector 100. The first body portion 104 includes a fluid opening or cavity 150 (FIG. 2 and the end view of FIG. 4) in the end surface 113. The opening 150 transitions to and communicates with a fluid passage or chamber 162 (FIG. 5) that then transitions to and communicates with fluid passages 154, 156, 158, 160. The chamber 162 adjacent the fluid opening 150 provides a fluid interconnect or gallery between the plurality of fluid passages 154, 156, 158, 160 and a first fluid port 164 through the outer body surface 111.

The first body portion 104 also includes a fluid passage 152. In some embodiments, the portion of the fluid passage 152 in the body portion 104 includes threads for receiving a plug after manufacturing the fluid passage 152. A second fluid port 166 through the outer body surface 111 communicates with fluid passage 152. In sonic embodiments, the port 166 includes a national pipe thread or NPT. In exemplary embodiments, the fluid passage 152 is completely separate from the opening 150, the chamber 162, and the plurality of fluid passages 154, 156, 158, 160 such that a fluid flow path is provided through fluid passage 152 that is independent of the flow path or flow paths through the opening 150, the chamber 162, and the plurality of fluid passages 154, 156, 158, 160. Axially displaced from the ports 164, 166 in the outer body surface 111 are threaded holes 180, 182. In other embodiments, the holes 180,182 are drilled and configured to receive "j-locking" pins that can be welded into the holes 180, 182.

The fluid passages 154, 156, 158, 160 and the fluid passage 152 extend through the first body portion 104 and into the intermediate body portion 106 as shown in FIG. 2. As shown in the cross-section of FIG. 6, these passages are separate from each other, set apart by body material in different radial positions of the body portion 104. The passages continue in such a manner as they extend into the intermediate body portion 106, as further shown in the cross-section of FIG. 7. The fluid passages 154, 156, 158, 160 terminate in the intermediate body portion 106 at respective openings 170, 172, 174, 176 in the recessed portion 122 outer surface. In some embodiments, the openings 170, 172, 174, 176 include an elongated, oblong, or pill shape. In some embodiments, the openings 170, 172, 174, 176 each include a flow area. Taken together, the openings 170, 172, 174, 176 include an effective flow area that is larger than the flow area of each opening. For example, each opening 170, 172, 174, 176 may include an equivalent flow area of a one-quarter inch hole. The effective equivalent flow area of the combined openings 170, 172, 174, 176 may be, for example, substantially equal to the flow area of a half-inch hole. Consequently, in certain embodiments, the flow rate capacity between the single port 164 and the plurality of openings 170, 172, 174, 176 is increased or maximized for an API standardized fluid connector 100. Furthermore, the increased flow rate capacity between the port 164 and the openings 170, 172, 174, 176 is assisted by the flow path including the chamber 162 and the fluid passages 154, 156, 158, 160 respectively coupled to the openings 170, 172, 174, 176. In certain embodiments, the flow rate capacity of a first flow path through the fluid connector 100 is increased via four elongated or pill-shaped openings 170, 172, 174, 176 that correspond to four independent fluid passages 154, 156, 158, 160 that then transition into a combined flow path in the chamber 162 and the port 164. In certain embodiments, the single flow path in the port 164 and the chamber 162 is split into four different flow paths in the fluid passages 154, 156, 158, 160 in order to maximize usage of the increased effective flow area of the corresponding openings 170, 172, 174, 176. Consequently, in some embodiments, only a single port 164 need he drilled through the outer surface 111 and into the first body portion 104 to fully communicate with the increased flow capacity fluid passages 154, 156, 158, 160 and corresponding openings 170, 172, 174, 176. It is understood that the total number of independent flow paths provided by the fluid passages 154, 156, 158, 160 and corresponding openings 170, 172, 174, 176 can be more or less than four and fully contemplated by the principles disclosed herein.

Figure 9:
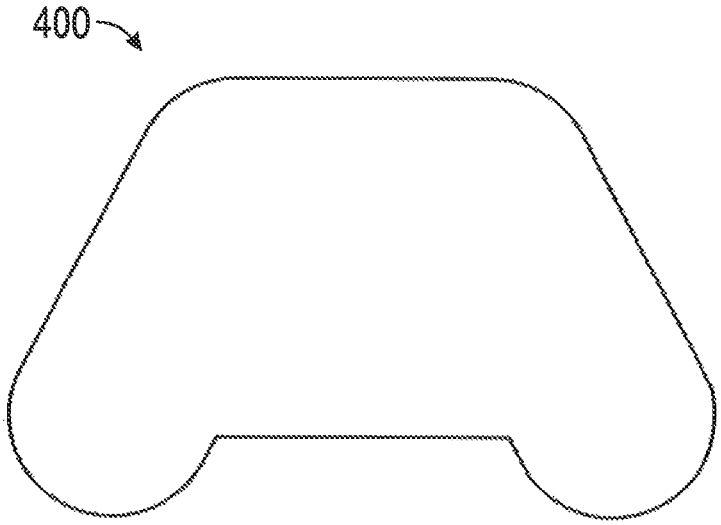
FIGS. 9 and 10 show a plug of the fluid connector.
Figure 10:
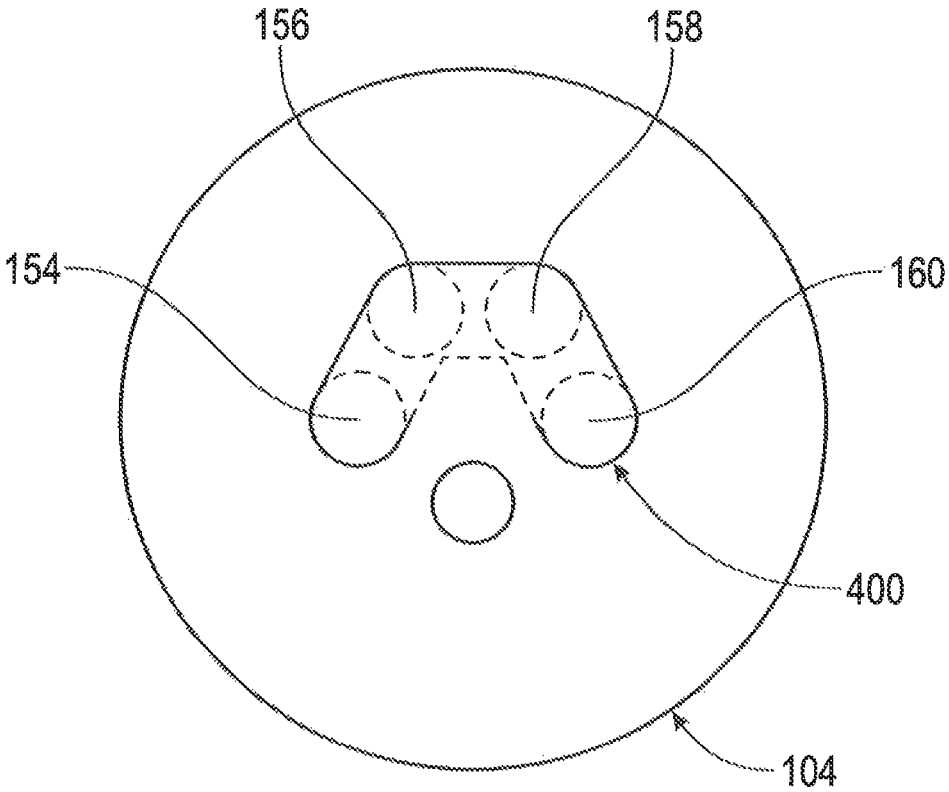

The fluid passage 152 provides a second flow path, and continues through the intermediate body portion 106 and into the second body portion 108 as shown in FIG. 2. With additional reference to the cross-section of FIG. 8, the fluid passage 152 terminates in the recessed portion 136 and includes a port 184 through the outer surface of the recessed portion 136 for communicating fluid. In some embodiments, the terminal end portion 144 includes a threaded hole 147, Referring to FIGS. 9 and 10, in some embodiments, a plug or pill 400 is coupled into the opening 150 after the opening 150, the chamber 162 and the fluid passages 154, 156, 158, 160 are drilled or bored out during manufacturing. In some embodiments, the plug or pill 400 includes an open C shape. The plug 400 is coupled into, such as by welding, the opening 150 to close off the flow path in the chamber 162 such that fluid is directed between the port 164 and the fluid passages 154, 156, 158, 160. Further, in some embodiments, the end piece 200 is welded onto the surface 113 of the first body portion 104. The coupled end piece 200 can stabilize the plug 400 and can provide backup support for the blockage provided by the installed plug 400.

Figure 11:
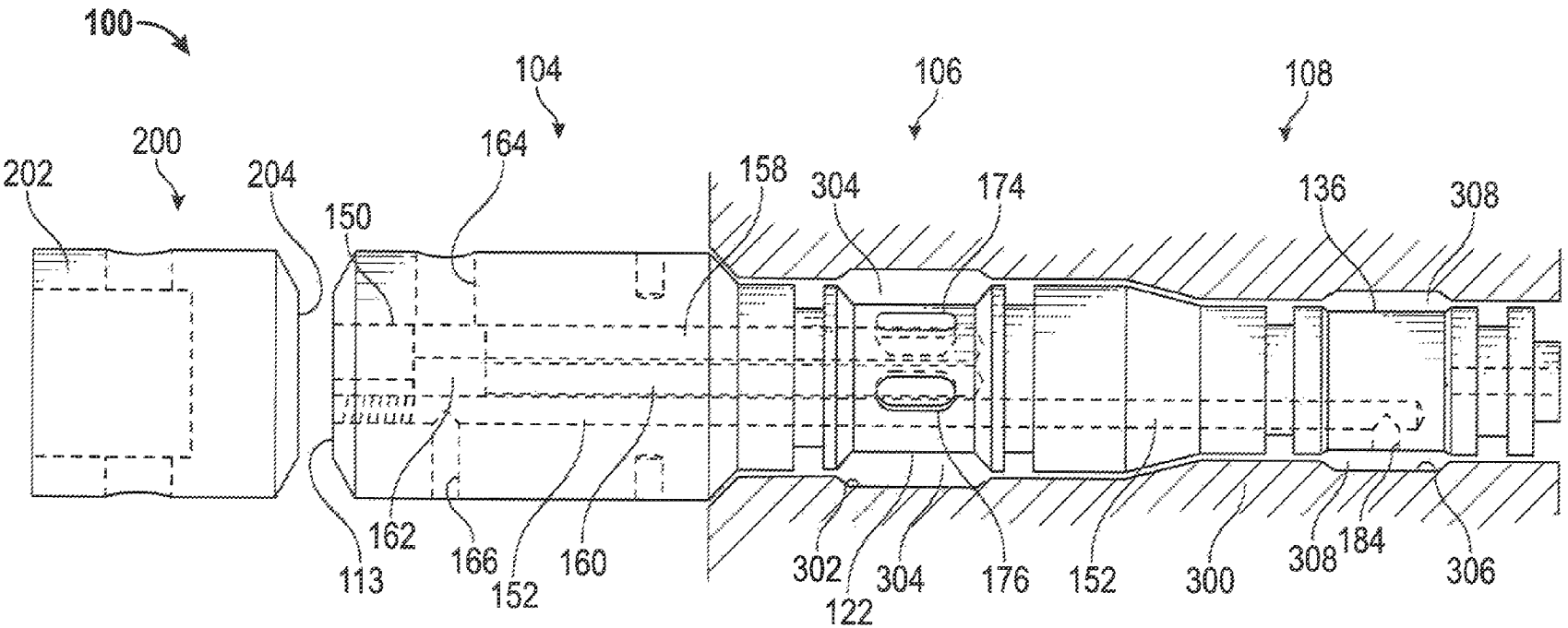
FIG. 11 is a view of the fluid connector of FIG. 2 coupled with a female connector.

In operation, such as when the fluid connector 100 is coupled between two fluid systems, fluid flows can be directed through the separate flow paths as identified above and described more fully below. Referring to FIG. 11, the fluid connector 100 can be coupled to or made up with a female connector 300. An inner surface 302 of the female connector 300 overlaps the recessed surface 122 of the connector 100 to form a chamber 304. In some embodiments, the chamber 304 accommodates or communicates an increased flow rate due to the increased effective flow area provided by the circumferentially disposed openings 170, 172, 174, 176 and their corresponding flow paths through the connector 100 as previously described. In further embodiments, the chamber 304 accommodates or communicates an increased flow rate due to the further reduced or recessed surface 122 as previously described, thereby increasing the volume of the chamber 304 that surrounds the surface 122. The increased effective flow rate through the openings 170, 172, 174, 176 and through the increased volume chamber 304 allows a higher flow rate to be communicated to/from the female connector 300 while maintaining an API standard connection between the connectors 100, 300.

Still referring to FIG. 11, an inner surface 306 of the female connector 300 overlaps the recessed surface 136 of the connector 100 to form a chamber 308. in some embodiments, the chamber 308 accommodates or communicates an increased flow rate due to the further reduced or recessed surface 136 as previously described, thereby increasing the volume of the chamber 308 that surrounds the surface 136. Consequently, in another aspect of the fluid connector 100, the second flow path through the fluid passage 152 includes an increased flow capacity such that a higher flow rate can be communicated to/from the female connector 300 while maintaining an API standard connection between the connectors 100, 300.

In some embodiments, the first increased capacity flow path via the port 164, the chamber 162, the fluid passages 154, 156, 158, 160, and the openings 170, 172, 174, 176 is independent of the second increased capacity flow path via the port 166, the fluid passage 152, and the port 184. Consequently, the flow rates and fluid pressures in the two flow paths can be kept separate and also stable relative to each other, in this manner, two different overall flow lines between two systems coupled via the connectors 100, 300 can be different sizes and/or flow rates without interfering with each other. Additionally, increased or higher flow rates can be accommodated over the flow lines using the increased flow capacity connector 100. In some embodiments, the first flow path accommodates a larger flow rate than the second flow path. In other words, the first flow path includes a larger cross-sectional flow area due to the effective or "compound" port made up of 154/170, 156/172, 158/174, and 160/176.

In some embodiments, the single chamber 162 means only one port 164 is required in the connector body 102 instead of four ports into the outer surface 111 for each of fluid passages 154, 156, 158, 160.

The fluid connector 100 can be connected between various systems, such as a ROV, a hydrate remediation skid, a distribution skid, an accumulator skid, a filter skid, or a hydraulic source or bladder. The fluid connector can be used for chemical injection, pressure testing, flushing, vacuuming, and other processes. Other systems and processes are also contemplated by this disclosure.

In any of the systems, applications, or processes described above or consistent with the disclosure herein, the fluid connector 100 provides a dual path or dual port stab connection. The dual port connection may be API compatible, such as API 17H compatible, and also configured to include a high flow port.

While specific embodiments have been shown and described, modifications can be made by one skilled in the art without departing from the scope or teachings herein. The embodiments as described are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described, but is only limited by the claims that follow, the scope of which shall include all equivalents of the subject matter of the claims.

The invention claimed is:

1. A subsea fluid connector comprising:

a body having a central axis, a first portion and a connection profile portion;

a first inlet port through an outer surface of the first portion;

a plurality of outlets through an outer surface of the connection profile portion;

a plurality of circumferentially-spaced parallel fluid passages extending axially through the body; and a fluid chamber in the body positioned between the first inlet port and the plurality of circumferentially-spaced parallel fluid passages, wherein each of the fluid passages is in fluid communication with the first inlet port and one of the outlet ports;

wherein each fluid passage extends from the fluid chamber to one of the outlets, and wherein each fluid passage is open to the fluid chamber.

2. The connector of claim 1 wherein the first inlet port, the fluid cavity, the plurality of circumferentially-spaced parallel fluid passages, and the plurality of outlets form a first fluid flow path through the body.

3. The connector of claim 2 further comprising a second fluid flow path through the body, wherein the second fluid flow path includes a second port though the outer surface of first portion, a third port through the outer surface of the connection profile portion, and a fluid passage coupled between the second and third ports.

4. The connector of claim 3 wherein the second fluid flow path and its fluid passage are independent of the first fluid flow path and the plurality of circumferentially-spaced parallel fluid passages.

5. The connector of claim 1 wherein the connection profile portion includes a first radially reduced recessed portion.

6. The connector of claim 5 wherein the connection profile portion includes a second radially reduced recessed portion.

7. The connector of claim 1 wherein the outlets are elongated, oblong, pill shaped, or a combination thereof.

8. The connector of claim 1 wherein each outlet includes a flow area and the plurality of outlets include an effective flow area.

9. The connector of claim 8 wherein the effective flow area is larger than the flow area of each outlet.

10. The connector of claim 1 wherein the plurality of outlets include an increased effective flow area and the connection profile portion includes an API standardized connection profile.

11. The connector of claim 10 wherein the API standardized connection profile includes at least one reduced recessed surface to communicate with the increased effective flow area.

12. The connector of claim 1 further comprising a plug disposed adjacent the fluid chamber.

13. The connector of claim 12 further comprising an end piece coupled adjacent the plug to back up the plug.

14. The connector of claim 1 wherein the connection profile portion is configured to mate with a female connector to provide a high flow capacity and API standardized fluid connector.

15. The connector of claim 1, wherein the inlet and the fluid chamber are configured to flow a fluid into all of the fluid passages simultaneously; and wherein the fluid passages are configured to simultaneously flow the fluid from the fluid chamber to all of the plurality of outlets.

16. A subsea fluid connector comprising:

a body having a central axis, a first portion and a connection profile portion to be received by a female connector;

a first fluid flow path extending through the body, wherein the first fluid flow path includes a first inlet port through an outer surface of the first portion, a plurality of circumferentially-spaced parallel fluid passages, a plurality of outlets through an outer surface of the connection profile portion, and a fluid chamber positioned between the first inlet port and the plurality of circumferentially-spaced parallel fluid passages, wherein each of the fluid passages is in fluid communication with the first inlet port and one of the outlet ports, wherein each fluid passage extends from the fluid chamber to one of the outlets, and wherein each fluid passage is open to the fluid chamber;

wherein each of the fluid passages is in fluid communication with the first inlet port and one of the outlets; and a second fluid flow path extending through a fluid passage between a second port through the outer surface of the first portion and a third port through the outer surface of the connection profile portion.

17. The connector of claim 16 wherein the first fluid flow path is completely separate from the second fluid flow path.

* * * * *